US012208937B2

(12) United States Patent
Usami

(10) Patent No.: US 12,208,937 B2
(45) Date of Patent: Jan. 28, 2025

(54) BOTTLE

(71) Applicant: YOSHINO KOGYOSHO CO., LTD., Tokyo (JP)

(72) Inventor: Tetsuro Usami, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 45 days.

(21) Appl. No.: 18/214,403

(22) Filed: Jun. 26, 2023

(65) Prior Publication Data

US 2024/0002097 A1 Jan. 4, 2024

(30) Foreign Application Priority Data

Jun. 30, 2022 (JP) ..... 2022-105773

(51) Int. Cl.
*B65D 1/02* (2006.01)

(52) U.S. Cl.
CPC ..... *B65D 1/0207* (2013.01); *B65D 1/0276* (2013.01); *B65D 2501/0018* (2013.01)

(58) Field of Classification Search
CPC .. B65D 1/0276; B65D 1/0207; B65D 1/0284; B65D 1/0261; B65D 2501/0018; B65D 2501/0027
See application file for complete search history.

(56) References Cited

U.S. PATENT DOCUMENTS

2010/0219152 A1* 9/2010 Derrien ..... B65D 1/0276 215/374
2015/0259090 A1* 9/2015 Dornbach ..... B65D 1/0276 215/371
2018/0127137 A1* 5/2018 Mahajan ..... B65D 1/0284
2020/0231335 A1* 7/2020 Manderfield ..... B65D 1/0276
2021/0362903 A1* 11/2021 Woloszyk ..... B65D 1/0276

FOREIGN PATENT DOCUMENTS

JP 5349780 B2 11/2013

* cited by examiner

*Primary Examiner* — Stephen J Castellano
(74) *Attorney, Agent, or Firm* — Oliff PLC

(57) ABSTRACT

The present invention relates to a bottle having a cylindrical shape with a bottom and formed of a synthetic resin material. In the bottle, a bottom portion includes a bottom wall portion, and a cylindrical heel portion. A plurality of recessed portions are provided in the bottom portion at equal intervals in a circumferential direction. A bottom surface of each of the plurality of recessed portions has a rectangular shape extending in the radial direction when viewed from below. When an interval in the circumferential direction between upper end portions located at the heel portion, among bottom surfaces of recessed portions adjacent to each other in the circumferential direction of the plurality of recessed portions, is defined as A, and a size in the circumferential direction of the upper end portions of the bottom surfaces of the recessed portions is defined as B, $1.0<A/B<3.2$ is satisfied.

3 Claims, 3 Drawing Sheets

BOTTLE

CROSS-REFERENCE TO RELATED APPLICATION

Priority is claimed on Japanese Patent Application No. 2022-105773, filed Jun. 30, 2022, the content of which is incorporated herein by reference.

BACKGROUND OF THE INVENTION

Field of the Invention

The present invention relates to a bottle.

Description of Related Art

From the related art, as a bottle made of a synthetic resin material and formed in a cylindrical shape with a bottom, as shown in Japanese Patent No. 5349780, for example, a configuration is known in which a bottom portion includes a bottom wall portion with a ground contact portion located on an outer peripheral edge portion, and a cylindrical heel portion that extends upward from the outer peripheral edge portion of the ground contact portion and is formed in a curved surface shape protruding outward in a radial direction.

By reducing the weight of the bottle, when a large compressive load is applied to the bottle in a vertical direction, there is a likelihood that the bottom portion may be easily deformed such that a lower end portion of the heel portion is caught inward in the radial direction between the ground contact surface and the lower end portion. In this case, for example, a fold extending in the radial direction or the like is more likely to occur in a portion of the bottom wall portion that is located further inward in the radial direction than the ground contact portion. That is, it becomes difficult to secure the filling buckling strength.

The present invention provides a bottle in which filling buckling strength can be improved.

SUMMARY OF THE INVENTION

A first aspect of the present invention is a bottle having a cylindrical shape with a bottom and formed of a synthetic resin material. In the bottle, a bottom portion includes a bottom wall portion in which a ground contact portion is located on an outer peripheral edge portion, and a cylindrical heel portion which extends outward in a radial direction as it goes upward from an outer peripheral edge of the ground contact portion, and which is formed into a curved surface shape protruding outward in the radial direction. A plurality of recessed portions are provided in the bottom portion at equal intervals in a circumferential direction, the plurality of recessed portions extending from a portion of the ground contact portion separated from an inner peripheral edge of the ground contact portion outward in the radial direction to a lower end portion of the heel portion across the outer peripheral edge of the ground contact portion. A bottom surface of each of the plurality of recessed portions has a rectangular shape extending in the radial direction when viewed from below. When an interval in the circumferential direction between upper end portions located at the heel portion, among bottom surfaces of recessed portions adjacent to each other in the circumferential direction of the plurality of recessed portions, is defined as A, and a size in the circumferential direction of the upper end portions of the bottom surfaces of the recessed portions is defined as B, $1.0<A/B<3.2$ is satisfied.

In this case, a plurality of recessed portions, which extend from a portion of the ground contact portion separated from the inner peripheral edge of the ground contact portion outward in the radial direction to the lower end portion of the heel portion across the outer peripheral edge of the ground contact portion, are provided at the bottom portion at regular intervals in the circumferential direction. As a result, when a large compressive load is applied to the bottle in the vertical direction, even if the bottom portion is deformed such that the lower end portion of the heel portion is caught inward in the radial direction between the ground contact surface and the lower end portion, the heel portion and the ground contact portion can be deformed over the entire length in the circumferential direction with little variation. As a result, when a large compressive load is applied to the bottle in the vertical direction, it is possible to make it difficult to cause, for example, folds extending in the radial direction or the like at the portion of the bottom wall portion located on the inner side in the radial direction than the ground contact portion, and the filling buckling strength can be reliably improved in combination with the increased bottle internal pressure.

Also, the aforementioned A/B is greater than 1.0 and smaller than 3.2. Accordingly, the filling buckling strength can be reliably improved.

When the above-mentioned A/B becomes 1.0 or less, in the ground contact portion, a width of an abutting portion, which is located between the recessed portions adjacent to each other in the circumferential direction and abuts on the ground contact surface, becomes narrower, and when a large compressive load is applied to the bottle in the vertical direction, a stress easily concentrates on the abutting portion, which makes it difficult to secure the filling buckling strength.

When the aforementioned A/B is 3.2 or more, the width of the recessed portion becomes narrow, and when a large compressive load is applied to the bottle in the vertical direction, the stress easily concentrates on the portion of the abutting portion in which the recessed portion is located, which makes it difficult to secure the filling buckling strength.

According to a second aspect of the present invention, in the bottle of the first aspect, the size in the circumferential direction of each of the plurality of recessed portions narrows or widens from the heel portion side toward the ground contact portion side, and when the size in the circumferential direction of a lower end portion of the bottom surface of each of the plurality of recessed portions, the lower end portion being located at the ground contact portion, is defined as C, $0.6<C/B<1.2$ is satisfied.

In this case, the aforementioned C/B is greater than 0.6 and smaller than 1.2. Therefore, the filling buckling strength can be reliably improved.

When the aforementioned C/B is 0.6 or less, the size in the circumferential direction of the portion of the recessed portion located at the ground contact portion becomes narrow, and when a large compressive load is applied to the bottle in the vertical direction, a stress easily concentrates on the portion of the ground contact portion in which the recessed portion is located, which makes it difficult to secure the filling buckling strength.

When the aforementioned C/B is 1.2 or more, the size in the circumferential direction of the portion of the recessed portion located at the ground contact portion widens, and in the ground contact portion, the width of the abutting portion that is located between the recessed portions adjacent to each other in the circumferential direction and abuts on the ground contact surface narrows. Accordingly, when a large compressive load is applied to the bottle in the vertical direction, a stress easily concentrates on the abutting portion, which makes it difficult to ensure filling buckling strength.

In particular, in addition to the aforementioned C/B being greater than 0.6 and smaller than 1.2, the aforementioned A/B may be greater than 1.0 and smaller than 3.2. As a result, the heel portion and the ground contact portion can be reliably deformed over the entire length in the circumferential direction with little variation.

According to a third aspect of the present invention, in the bottle of the first aspect or the second aspect, in a vertical cross-sectional view along the vertical direction, a portion of the bottom surface of each of the plurality of recessed portions, the portion being located at the heel portion, extends outward in the radial direction as it goes upward, has a curved shape which protrudes outward in the radial direction, and is continued to the outer peripheral surface of the heel portion without a step.

In this case, in the vertical cross-sectional view along the vertical direction, a portion of the bottom surface of the recessed portion located at the heel portion extends outward in the radial direction as it goes upward, has a curved shape which protrudes outward in the radial direction, and is continued to the outer peripheral surface of the heel portion without a step. As a result, when a large compressive load is applied to the bottle in the vertical direction, it is possible to suppress concentration of stress on the connecting portion between the upper end portion of the bottom surface of the recessed portion and the outer peripheral surface of the heel portion.

According to an aspect of the present invention, the filling buckling strength can be improved.

DETAILED DESCRIPTION OF THE INVENTION

A bottle according to an embodiment of the present invention will be described below with reference to the drawings.

Figure 1:
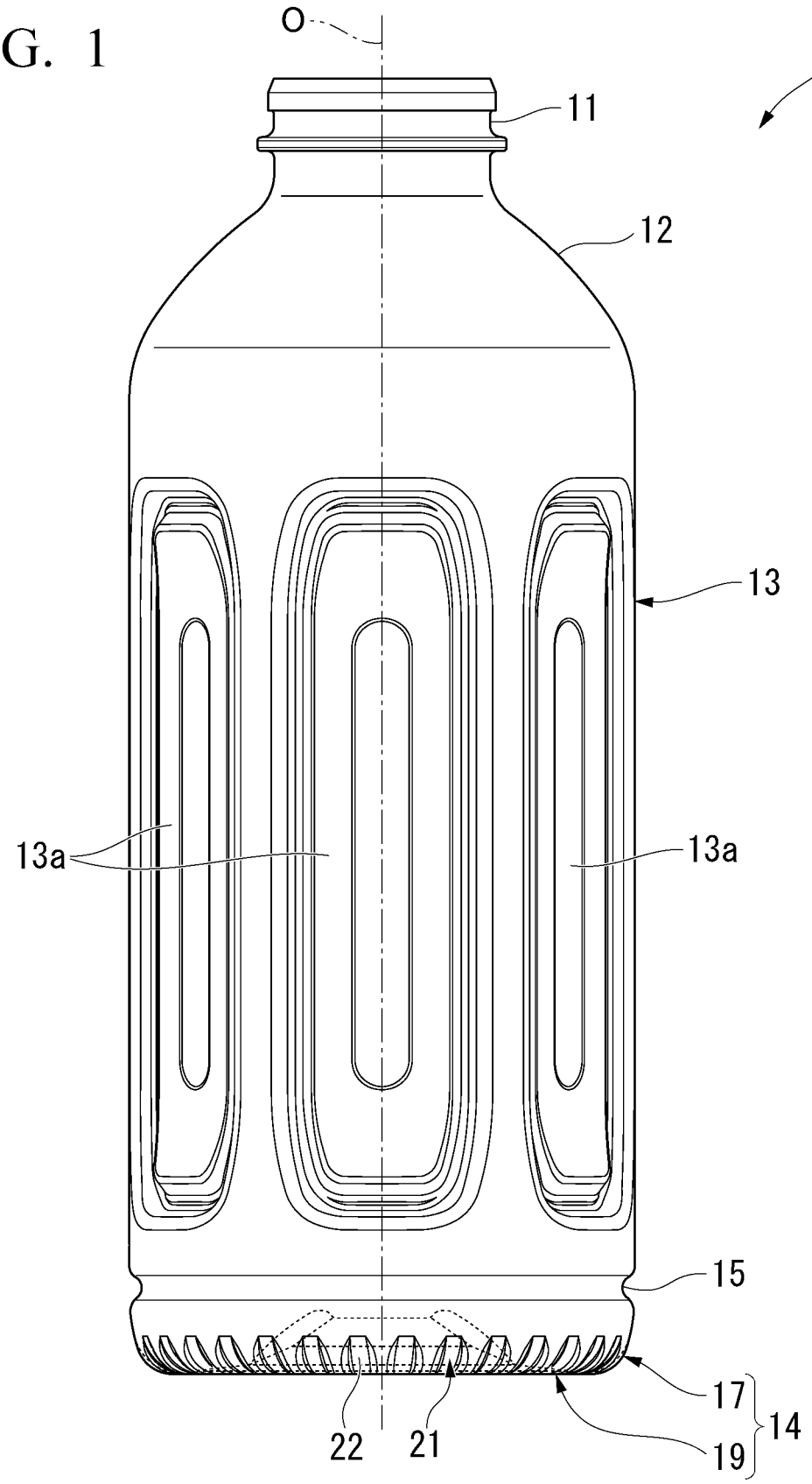
FIG. 1 is a side view of a bottle shown as an embodiment.

A bottle 1 according to this embodiment includes, as shown in FIG. 1, a mouth portion 11, a shoulder portion 12, a body portion 13 and a bottom portion 14, and has a schematic configuration in which the mouth portion 11, the shoulder portion 12, the body portion 13 and the bottom portion 14 are connected consecutively in this order with their central axes located on a common axis. An internal volume of the bottle 1 has a size in which contents of, for example, 300 ml or more and 2,000 ml or less are filled.

Hereinafter, the common axis will be referred to as a bottle axis O, a mouth portion 11 side along a direction of the bottle axis O will be referred to as an upper side, a bottom portion 14 side will be referred to as a lower side, and a direction along the bottle axis O will be referred to as a vertical direction. Further, a direction intersecting the bottle axis O when viewed from the vertical direction will be referred to as a radial direction, and a direction rotating around the bottle axis O will be referred to as a circumferential direction.

Further, the bottle 1 is formed by blow-molding a preform formed into a cylindrical shape with a bottom by injection molding, and is integrally formed of a synthetic resin material. A cap (not shown) is attached to the mouth portion 11. The mouth portion 11, the shoulder portion 12, the body portion 13, and the bottom portion 14 each have a circular cross-sectional shape orthogonal to the bottle axis O.

A plurality of vertically elongated rectangular panel portions 13*a* are formed on the body portion 13 at intervals in the circumferential direction. An annular groove 15 extending continuously over the entire circumference is formed at the lower end portion of the body portion 13 located below the panel portion 13*a*. The annular groove 15 is formed in the shape of a concave curved surface that is depressed inward in the radial direction. The annular groove 15 may be formed in a portion of the body portion 13 other than the lower end portion. An outer diameter of the lower end portion of the body portion 13 is, for example, 55 mm or more and 110 mm or less. In the shown example, the outer diameter of the lower end portion of the body portion 13 is approximately 82 mm.

Figure 2:
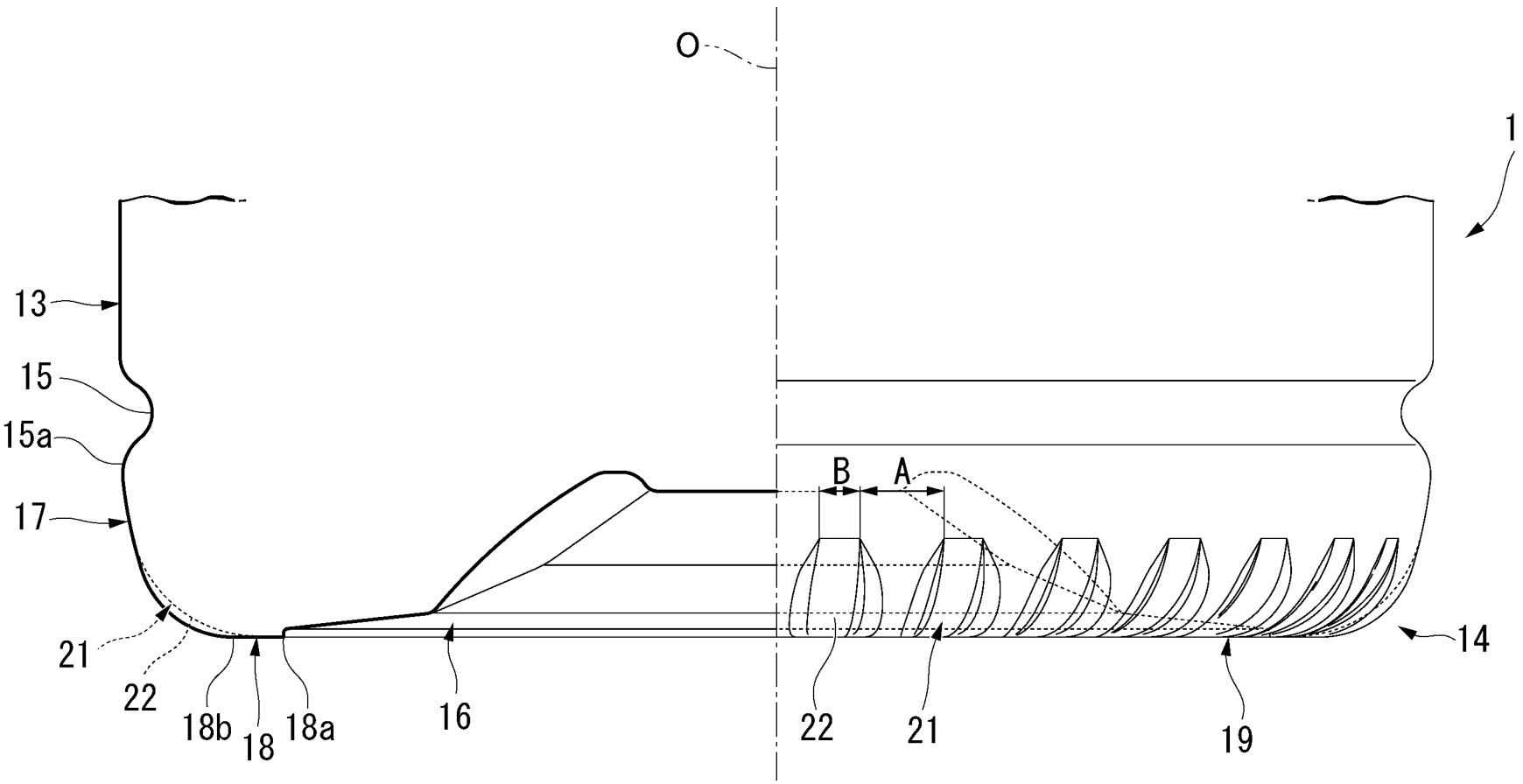
FIG. 2 is a semi-longitudinal cross-sectional view of a bottom portion of the bottle of FIG. 1.

As shown in FIG. 2, the bottom portion 14 includes a bottom wall portion 19 with a ground contact portion 18 located at an outer peripheral edge portion, and a cylindrical heel portion 17 that extends outward in the radial direction as it goes upward from an outer peripheral edge 18*b* of the ground contact portion 18, and is formed in a curved surface shape protruding outward in the radial direction.

The ground contact portion 18 has a width in the radial direction, and extends continuously over the entire circumference.

An upper end opening edge of the heel portion 17 is connected to a lower end opening edge of the body portion 13. The upper end portion of the heel portion 17 is vertically connected to the opening peripheral edge portion 15*a* located on the lower side out of the pair of upper and lower opening peripheral edge portions of the annular groove 15 in the body portion 13 without a step. The lower end opening edge of the heel portion 17 is connected to the outer peripheral edge of the bottom wall portion 19, that is, the outer peripheral edge 18*b* of the ground contact portion 18. A lower end portion of the heel portion 17 is formed into a curved surface shape that protrudes in an obliquely downward direction that faces outward in the radial direction. A portion of the bottom wall portion 19 located inward in the radial direction of the ground contact portion 18 is a depressed portion 16 that is recessed upward.

In the present embodiment, in the bottom portion 14, a plurality of recessed portions 21, which extend from a portion of the ground contact portion 18 separated from the inner peripheral edge 18*a* of the ground contact portion 18 outward in the radial direction to the lower end portion of the heel portion 17 across the outer peripheral edge 18*b* of the ground contact portion 18, are provided at regular intervals in the circumferential direction.

The upper end portion of the recessed portion 21 is located below the upper end portion of the heel portion 17.

Figure 3:
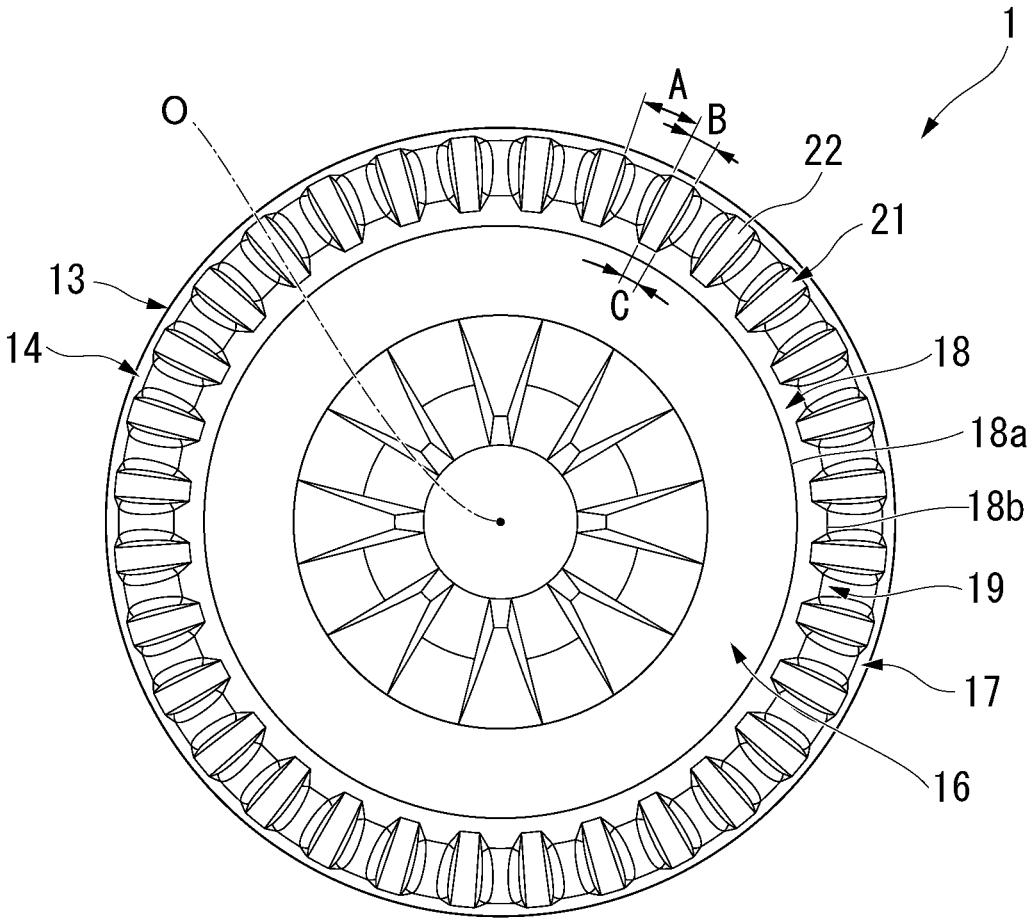
FIG. 3 is a bottom view of the bottle of FIG. 1.

As shown in FIG. 3, the bottom surface 22 of the recessed portion 21 has a rectangular shape extending in the radial direction when viewed from below. That is, when viewed from below, the bottom surface 22 of the recessed portion 21 is provided in the direction in which, among four sides that define a rectangular shape, two sides are located at both end portions in the circumferential direction and extend in the radial direction, and the remaining two sides are located at the both end portions in the radial direction and extend in the circumferential direction. The bottom surface 22 of the recessed portion 21 has a rectangular shape elongated in the radial direction when viewed from below.

The bottom surface 22 of the recessed portion 21 may have a square shape extending in the radial direction when viewed from below, or may have a rectangular shape elongated in the circumferential direction.

Among the bottom surfaces 22 of the recessed portions 21 adjacent to each other in the circumferential direction, when an interval in the circumferential direction between the upper end portions located at the heel portion 17 is defined as A, and a size in the circumferential direction of the upper end portions of the bottom surfaces 22 of the recessed portions 21 is defined as B, $1.0<A/B<3.2$, preferably, $2.0<A/B<3.0$ is satisfied. The aforementioned interval A is 3.0 mm or more and 9.0 mm or less, preferably 4.0 mm or more and 8.0 mm or less. The aforementioned size B is 2.0 mm or more and 6.0 mm or less, preferably 2.5 mm or more and 4.0 mm or less.

The size in the circumferential direction of the recessed portion 21 narrows or widens from the heel portion 17 side toward the ground contact portion 18 side. When the size in the circumferential direction of the upper end portion of the bottom surface 22 of the recessed portion 21 is defined as B, and the size in the circumferential direction of the lower end portion of the bottom surface 22 of the recessed portion 21 located at the ground contact portion 18 is defined as C, a relationship of $0.6<C/B<1.2$, preferably $0.8<C/B<1.0$ is satisfied The aforementioned size C is 1.6 mm or more and 4.8 mm or less, preferably 2.0 mm or more and 3.2 mm or less. In the shown example, the size of the recessed portion 21 in the circumferential direction narrows from the heel portion 17 side toward the ground contact portion 18 side. A lower end portion of the recessed portion 21 is located at a central portion in the radial direction of the ground contact portion 18. The aforementioned size C is for the portion of the bottom surface 22 of the recessed portion 21 that is located at the central portion in the radial direction of the ground contact portion 18.

As shown in FIG. 2, in a vertical cross-sectional view along the vertical direction, a portion of the bottom surface 22 of the recessed portion 21 located at the heel portion 17 extends outward in the radial direction as it goes upward, has a curved shape that protrudes outward in the radial direction, and is continued to the outer peripheral surface of the heel portion 17 without steps. A portion of the bottom surface 22 of the recessed portion 21 located at the heel portion 17 is formed in a curved surface that protrudes in an obliquely downward direction that faces outward in the radial direction.

In a vertical cross-sectional view along the vertical direction, a radius of curvature (approximately 6 mm) of the outer peripheral surface of the lower end portion of the heel portion 17 is smaller than the radius of curvature (approximately 8 mm) of the portion of the bottom surface 22 of the recessed portion 21 located at the heel portion 17.

Among the bottom surfaces 22 of the recessed portion 21, the inner end portion in the radial direction of the portion located at the ground contact portion 18, is continued to the lower surface of the ground contact portion 18 without steps.

The number of recessed portions 21 is 20 or more, preferably 24 or more and 32 or less.

The plurality of recessed portions 21 are formed to have the same shape and size. Among the plurality of recessed portions 21, shapes and sizes of some of the recessed portions 21, may be different from shapes and sizes of other recessed portions 21.

As described above, according to the bottle 1 according to the present embodiment, a plurality of recessed portions 21, which extend from a portion of the ground contact portion 18 separated from the inner peripheral edge 18*a* of the ground contact portion 18 outward in the radial direction to the lower end portion of the heel portion 17 across the outer peripheral edge 18*b* of the ground contact portion 18, are provided in the bottom portion 14 at regular intervals in the circumferential direction. As a result, when a large compressive load is applied to the bottle 1 in the vertical direction, even if the bottom portion 14 is deformed such that the lower end portion of the heel portion 17 is caught inward in the radial direction between the ground contact surface and the lower end portion, the heel portion 17 and the ground contact portion 18 can be deformed over the entire length in the circumferential direction with little variation. As a result, when a large compressive load is applied to the bottle 1 in the vertical direction, it is possible to make it difficult to cause, for example, folds extending in the radial direction or the like at the portion of the bottom wall portion 19 located on the inner side in the radial direction than the ground contact portion 18, and the filling buckling strength can be reliably improved in combination with the increased bottle internal pressure.

Also, the aforementioned A/B is greater than 1.0 and smaller than 3.2. Therefore, the filling buckling strength can be reliably improved.

Also, the aforementioned C/B is greater than 0.6 and smaller than 1.2. Accordingly, the filling buckling strength can be reliably improved.

In particular, in addition to the aforementioned C/B being greater than 0.6 and smaller than 1.2, the aforementioned A/B is greater than 1.0 and smaller than 3.2. As a result, the heel portion 17 and the ground contact portion 18 can be reliably deformed over the entire length in the circumferential direction with little variation.

In addition, in a vertical cross-sectional view along the vertical direction, a portion of the bottom surface 22 of the recessed portion 21 that is located at the heel portion 17 extends outward in the radial direction as it goes upward, has a curved shape that protrudes outward in the radial direction, and is continued to the outer peripheral surface of the heel portion 17 without a step. As a result, when a large compressive load is applied to the bottle 1 in the vertical direction, it is possible to suppress concentration of stress on a connecting portion between the upper end portion of the bottom surface 22 of the recessed portion 21 and the outer peripheral surface of the heel portion 17.

Next, a verification test of the operating effects described above will be explained.

A plurality of types of bottles with different A/B were modeled, the stress generated in each part of each bottle was numerically analyzed when applying a compressive load in the vertical direction, and a compressive load in the vertical direction that causes, for example, folds extending in the radial direction at a portion of the bottom wall portion located on the inner side in the radial direction than the ground contact portion was calculated.

As a result, in the bottle of Comparative Example 1 in which the above-mentioned A/B is 1.0 or less, it was confirmed that the aforementioned folds occurred, starting from the portion of the ground contact portion that is located between the recessed portions adjacent to each other in the circumferential direction and abuts on the ground contact portion.

In the bottle of Comparative Example 2 in which the aforementioned A/B is 3.2 or more, it was confirmed that the above-mentioned folds occurred, starting from the portion of the ground contact portion in which the recessed portion is located.

In the case of the bottle 1 in which A/B is larger than 1.0 and smaller than 3.2, even if the vertical compressive load that caused the above-described folds in the bottle of Comparative Examples 1 and 2 is applied, it was confirmed that the aforementioned folds do not occur.

The technical scope of the present invention is not limited to the above-described embodiments, and various modifications can be made without departing from the scope of the present invention.

For example, the size of the recessed portion 21 in the circumferential direction may be the same over the entire length.

The bottom surface 22 of the recessed portion 21 may extend linearly outward in the radial direction as it goes upward.

As the synthetic resin material that forms the bottle 1, for example, polyethylene terephthalate, polyethylene naphthalate, amorphous polyester, or the like, a blend material thereof, or the like may be appropriately changed.

The bottle 1 is not limited to a single-layer structure, and may be a stacked structure having an intermediate layer. Examples of the intermediate layer include a layer made of a resin material having gas barrier properties, a layer made of a recycled material, a layer made of a resin material having oxygen absorption properties, and the like.

While preferred embodiments of the invention have been described and shown above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A bottle having a cylindrical shape with a bottom and formed of a synthetic resin material, wherein a bottom portion includes a bottom wall portion in which a ground contact portion is located on an outer peripheral edge portion, and a cylindrical heel portion which extends outward in a radial direction as it goes upward from an outer peripheral edge of the ground contact portion, and which is formed into a curved surface shape protruding outward in the radial direction, a plurality of recessed portions are provided in the bottom portion at equal intervals in a circumferential direction, the plurality of recessed portions extending from a portion of the ground contact portion separated from an inner peripheral edge of the ground contact portion outward in the radial direction to a lower end portion of the heel portion across the outer peripheral edge of the ground contact portion, a bottom surface of each of the plurality of recessed portions has a rectangular shape extending in the radial direction when viewed from below, and when an interval in the circumferential direction between upper end portions located at the heel portion, among bottom surfaces of recessed portions adjacent to each other in the circumferential direction of the plurality of recessed portions, is defined as A, and a size in the circumferential direction of the upper end portions of the bottom surfaces of the recessed portions is defined as B, $1.0<A/B<3.2$ is satisfied.

2. The bottle according to claim 1, wherein the size in the circumferential direction of each of the plurality of recessed portions narrows or widens from the heel portion side toward the ground contact portion side, and when the size in the circumferential direction of a lower end portion of the bottom surface of each of the plurality of recessed portions, the lower end portion being located at the ground contact portion, is defined as C, $0.6<C/B<1.2$ is satisfied.

3. The bottle according to claim 1, wherein in a vertical cross-sectional view along the vertical direction, a portion of the bottom surface of each of the plurality of recessed portions, the portion being located at the heel portion, extends outward in the radial direction as it goes upward, has a curved shape which protrudes outward in the radial direction, and is continued to the outer peripheral surface of the heel portion without a step.

* * * * *